US006330724B1

(12) United States Patent
Belle

(10) Patent No.: US 6,330,724 B1
(45) Date of Patent: Dec. 18, 2001

(54) DRAIN COVER LOCKING DEVICE

(76) Inventor: Robert K. Belle, 495 Lakeside Blvd., Franklin Lakes, NJ (US) 07417

( * ) Notice: Subject to any disclaimer, the term of this patent is extended or adjusted under 35 U.S.C. 154(b) by 0 days.

(21) Appl. No.: 09/458,720

(22) Filed: Dec. 13, 1999

(51) Int. Cl.[7] ..... E04D 13/04
(52) U.S. Cl. ..... 4/288; 4/286; 403/300
(58) Field of Search ..... 4/288, 286, 652, 4/292; 403/300, 301, 305

(56) References Cited

U.S. PATENT DOCUMENTS

| | | | | |
|---|---|---|---|---|
| 216,238 | * | 6/1879 | Sutton | 4/286 |
| 2,403,402 | * | 7/1946 | Rossi | 403/300 |
| 2,896,223 | * | 7/1959 | Treslo | 4/286 |
| 6,165,357 | * | 12/2000 | Cormier | 210/163 |

* cited by examiner

*Primary Examiner*—Lynne H. Browne
*Assistant Examiner*—John R. Cottingham
(74) *Attorney, Agent, or Firm*—Donald R. Heiner

(57) ABSTRACT

A drain cover locking device which fits into a drain pipe for the purpose of receiving and holding in place a standard drain cover. In general, the locking device is made of a solid generally rectangular piece of bar material, usually of metal, with one hole drilled through the center of the bar for receiving a fastener, such as a screw, and preferably a tamper-proof screw head, which is first inserted through a center hole in the drainer cover. A threaded rod having an "L" shaped hanger is threaded into each end of the bar material and the "L" shaped piece fits over the drain pipe for holding the mechanism in place. The center piece or generally rectangular piece of bar material is then turned with a wrench or other device until the bar material is firmly held in place over the pipe and the drain screw is then placed over the pipe with the center hole aligned with the center hole of the center bar. The fastening device is then threaded through the screen and into the center piece for holding it in place.

6 Claims, 4 Drawing Sheets

DRAIN COVER LOCKING DEVICE

BACKGROUND OF INVENTION

1. Field of the Invention

The present invention generally involves the field of technology pertaining to a device to which a drain screen or drain cover may be fastened over or to an open drain pipe for which there is no other means of fastening. The purpose of providing a tamper-resistant attachment for a drain screen is to prevent its removal from a drain pipe and thereby preventing any debris, or any other foreign matter from being pushed or swept into the drain by a worker cleaning the floor of a kitchen in a restaurant or hospital or hotel or any other large commercial or industrial type facility. Currently, for the most part, these drains are protected from debris by simply laying a screen or strainer over the drain or discharge pipe. They are therefore easily removed for the convenience of a cleaning crew who tend to simply lift the screen or strainer and sweep garbage into the drain.

These drains are generally recessed into the floor and are primarily used for indirect discharge waste lines.

In this type of environment, sanitary codes require a gap between a discharge line that exits a plumbing fixture and the actual drain itself that enters the floor and the drain line that is underground and attached to a receptor does not have a flange or collar nor any other means for accommodating a fastening device for the screen.

The locking device of this invention is adaptable to several different size and type drains which in turn will operate as a drain or screen mounting and locking device whereby various shape and size floor drain covers or strainers may be adapted by employing a vandal-proof screw.

2. Description of the Prior Art

A search of the prior art has uncovered the following patents: U.S. Pat. No. 931,019 to E. L. Dawes & J. C. Reed; U.S. Pat. No. 1,195,827 to G. A. Lucke; U.S. Pat. No. 149,489 to J. Lewis; U.S. Pat. No. 1,900,658 to E. F. Niedecken; U.S. Pat. No. 1,601,498 to J. Hirshstein; U.S. Pat. No. 645,749 to H. C. G. Kasschau; U.S. Pat. No. 4,257,892 to Boersma; and, U.S. Pat. No. 4,621,939 to Thomann et al.

The patent to Dawes & Reed, U.S. Pat. No. 931,019 is of interest for its teaching in FIG. 1 and on page 2, lines 45–50. That language states "At the center the strainer is depressed in making it, or countersunk to receive a screw head and a screw 12 passes through the strainer at this point and engages a threaded opening 20 formed in crossbar 10." This patent does not disclose a plurality of horizontally extending holes in a crossbar to receive left and right-hand threads nor a hanger attached to a threaded rod.

The patent to Lucke, U.S. Pat. No. 1,195,827 relates to a stopper and lavatory fixture and it is noted that a stopper is fastened in place by means of items 14 and 17 (apertures), screw 22, hook 23 and crossed arm spider D. Not shown in the Lucke patent however is a solid bar having both a vertical threaded hole and two horizontal, left and right-hand thread receiving means and the "L" shaped ears of the instant invention.

The patent to Lewis, U.S. Pat. No. 149,489, is of interest for its teaching of a cross-bar D and a screw T threadably engaging D. It is believed that there are the same differences between the instant invention and the Lewis patent as there is between the instant invention and the prior patents heretofore mentioned.

The patent to Niedecken, U.S. Pat. No. 1,900,658 for a shower stall is of some interest but, again, there are the same differences between this patent and the instant invention as there is between the foregoing mentioned patents and the instant invention.

The patent to Hirshstein, U.S. Pat. No. 1,601,498, relates to a Clamping Means having a clamp holding member 8 with a vertical leg passing through an opening through a lug 6 and a horizontal leg extending over the clamping ring 5. This is both structurally and conceptually different from the instant invention.

The patent to Kasschau, U.S. Pat. No. 645,749 is of minimal interest only for the language contained in Column 1, lines 35–41. This patent does not disclose the feature of a rectangular bar and a vertical screw hole opening nor the two horizontal openings having hangers attached thereto which hangers are "L" shaped as disclosed in the instant invention.

The Boersma patent, U.S. Pat. No. 4,257,892, describes four radial slots in which trapezoidal locking slugs are slidably positioned and where these slugs communicate with four radial slots. Again, this differs substantially both structurally and conceptually from the instant invention.

U.S. Pat. No. 4,621,939 to Thomann et al. is of interest for its teaching in FIGS. 2 and 3, in particular, and Items 40–45. The crossbar and hangers of the instant invention are not disclosed in this patent.

None of the above references, either singularly or taken together teach or even suggest the unique combination of the invention disclosed herein.

SUMMARY OF THE INVENTION

According to the present invention a drain cover locking device is provided whereby the device can be disposed into a drain pipe for the purpose of receiving and holding in place any standard drain cover. The drains are generally those found in floor sinks or floor receptors. Currently, these types of drains are protected from debris by simply laying a screen or strainer over the drain pipe. Generally, in restaurants, and other large facilities such as hotels and the like, these covers do not stay in place for more than a short period of time. They are frequently removed for the convenience of the personnel in charge of cleaning the facility. It is more convenient for them to simply lift off the drain and dispose of garbage or sweepings into the main discharge drain.

The purpose of the instant invention is to provide a tamper-resistant attachment device to which a drain screen or drain cover may be fastened over an open drain pipe for which there is no other means of fastening. The intent is to help eliminate any debris or foreign matter from being swept down the drain either intentionally or accidentally. The instant invention is adapted to receive almost an infinite variety of drain covers and size of discharge drains. Little is required in the way of hand tools to install the device into a drain and to secure a screen or drain cover to the device by means of a fastener having a tamper-resistant head.

The device of the instant invention generally comprises a solid, generally rectangular piece of bar material, usually made of metal. One hole is drilled through the center of the bar, vertically, for receiving a fastener, such as a screw having a tamper-resistant head, which would first be inserted through a center hole in the drain cover. Each end of the bar has internal threads for receiving left-hand and right-hand threaded rods. Each of the threaded rods, in turn, has a hanger attached to it and which is "L" shaped. The hangers are used to rotate the threaded rods into and out of the rectangular shaped center piece. The horizontal portion or ear of the "L" shaped piece fits over a drain pipe for holding the mechanism in place. The bar or center piece is then turned with a wrench or any other suitable device until the unit is firmly held in place over the entrance to the discharge pipe and the drain screen is then placed over the pipe with the center hole aligned with the center hole of the bar. The fastening device having a tamper-resistant head is then threaded through the screen and into the center piece or center bar for holding it in place.

Thus, with the center bar in place over the entrance to a drain pipe and being held in place by means of the "L" shaped hangers and with the center piece then turned with a wrench or other suitable device until the unit is firmly held in place over the entrance to the discharge pipe, the drain screen can then be placed over the pipe with the center hole aligned with the center hole of the center bar and the fastening device threaded through the screen and into the center piece for holding it in place.

As can be seen it would be extremely difficult for someone to either accidentally or purposely remove the drain screen from the device of the instant invention and thus prevent debris from being disposed through the drain.

It is therefore an object of the present invention to provide a drain cover locking device.

It is another object of the invention to provide a drain cover locking device being adaptable to any size drain opening and with any type of drain screen.

It is a further object of the invention to provide such a drain cover locking device wherein the device has an opening therein for receiving a tamper-resistant fastening device for securing a drain screen to the device.

It is another object of the invention to provide such a drain cover locking device having means for attaching such device to a drain opening.

These and further objects, features and advantages of the invention shall become apparent from the following detailed description of a preferred embodiment thereof when taken in conjunction with the drawings wherein like reference characters refer to corresponding parts in the several views.

DETAILED DESCRIPTION OF THE PREFERRED EMBODIMENT

A unique device for firmly holding in place and securing a screen or strainer over the entrance of a drain pipe or discharge pipe usually associated with large commercial or industrial use such as restaurants, hospitals, and the like. The unique device of this invention can be adapted to secure any size or shape screen or strainer over such a drain or discharge pipe.

Such strainers or drains currently in use are normally protected from debris by simply laying a screen or strainer over the drain pipe. They are therefore subject to easy removal and, therefore, foreign objects, even including kitchen utensils, are easily swept down the drain for the convenience of a cleaning crew since it is easy for them to lift the drain and then simply drop it back in place.

Figure 1:
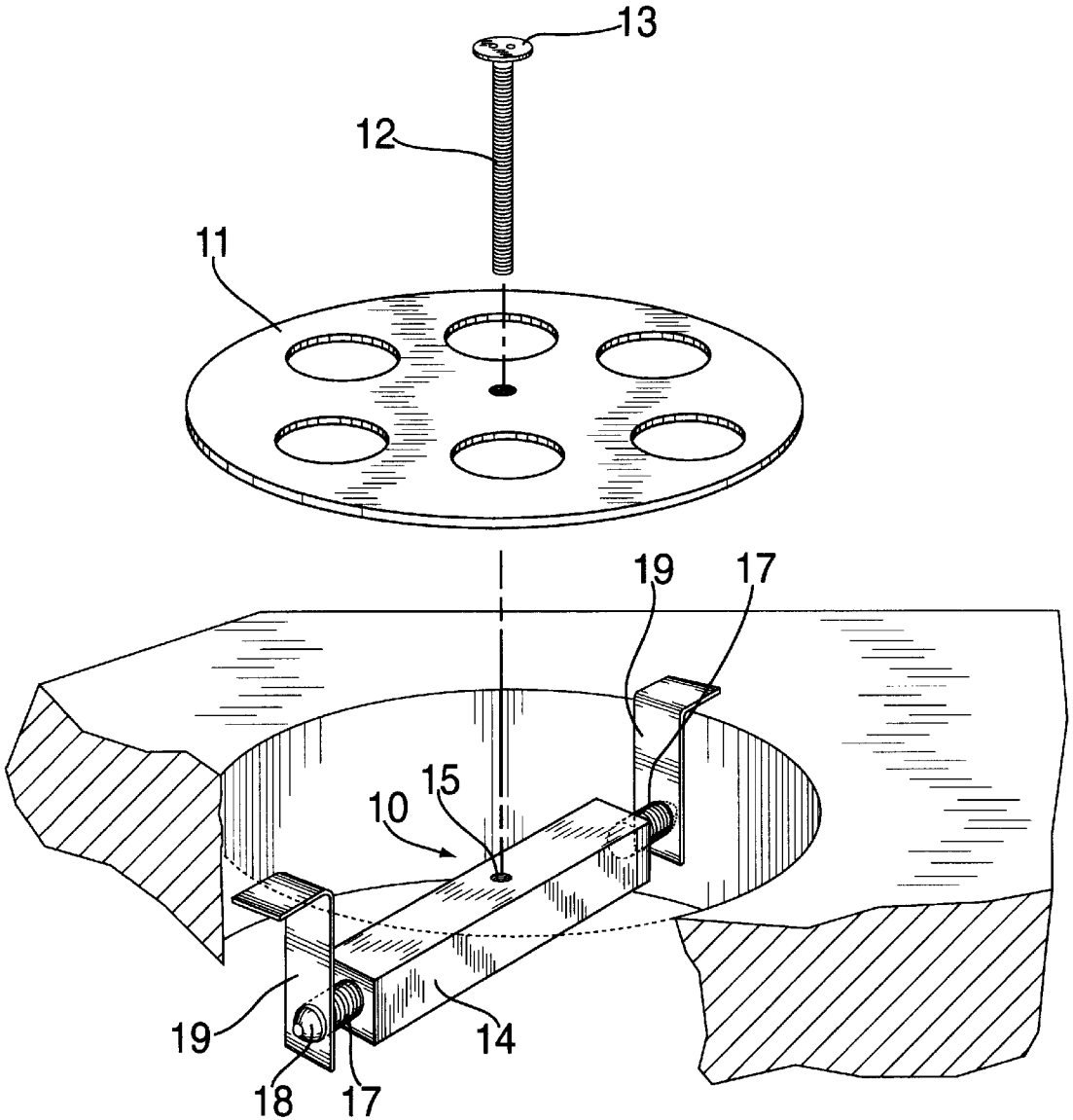
FIG. 1 is an exploded view showing the invention disposed in a drain opening and further showing the drain screen to be attached and the tamper-proof fastener for attaching the screen to the device of the invention.
Figure 2:
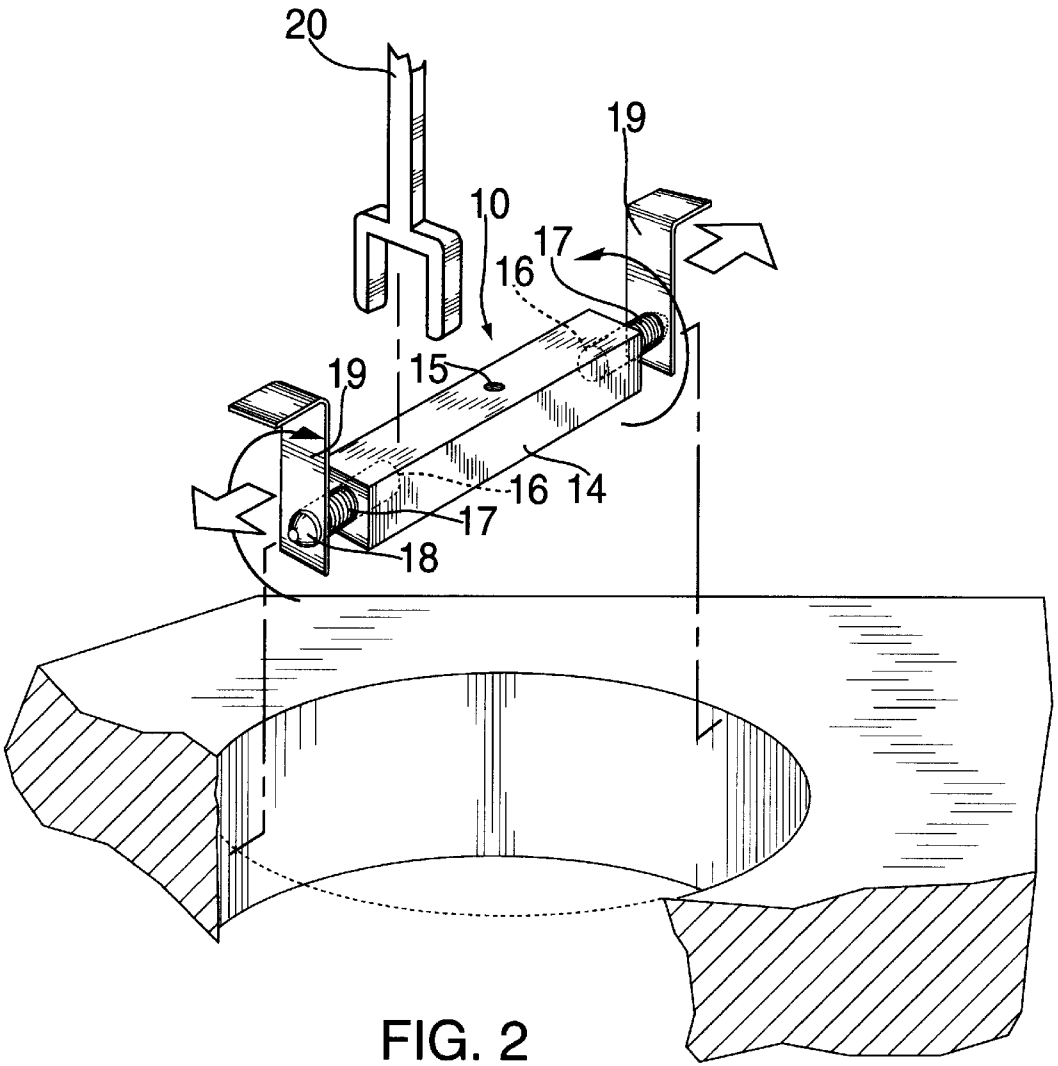
FIG. 2 is similar to FIG. 1, without the screen and fastening device and showing the instant invention above the drain opening.

The device which forms the subject matter of this invention is shown generally in all the figures as item 10 and is more particularly seen in its environment in FIGS. 1 and 2. This item 10 is a drain cover locking device.

Figure 4:
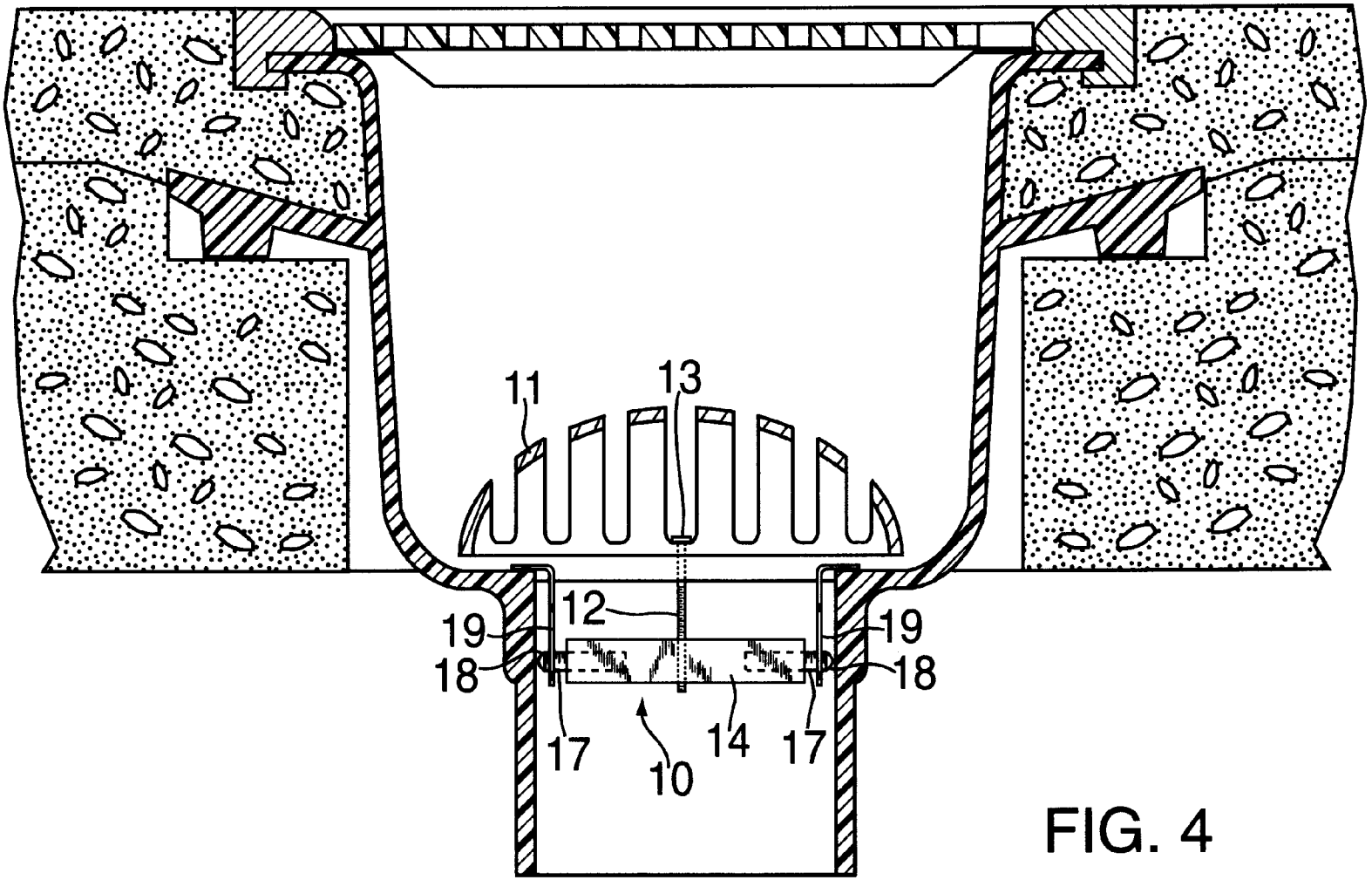
FIG. 4 is a cross-sectional view showing the instant invention installed in a floor sink with strainer in place.

Examples of the types of screens or strainers to be secured to and locked in place over the drain cover locking device 10 are shown at 11 in FIGS. 1 and 4.

These screens or strainers 11 are secured to the drain cover locking device by means of any well known fastening device but preferably by means of a screw 12 having a tamper-proof screw head shown as 13 in FIG. 1.

The drain cover locking device 10 of the instant invention comprises a center bar 14 for receiving and holding in place a screen or strainer 11 by means of fastening device 12 having tamper-proof screw head 13 as will be more fully described below.

While the center bar 14 is shown as a rectangular piece of bar material in all the Figures of the drawings, it should be obvious that the bar may be round, square, or any other convenient shape and that it may be made of aluminum, some other metal, or in fact may be made of plastic or any other suitable material.

An opening 15 extends vertically through the bar at approximately its midpoint for receiving fastening device 12 which extends through a similar opening in the screen or stainer 11 as clearly seen in FIGS. 1 and 4.

It should be readily seen that with drain cover locking device 10 firmly in place such as shown in FIGS. 1 and 4 that a screen or strainer 11, again, as shown in FIGS. 1 and 4, may be placed over a discharge or drain pipe and the fastening device 12 extends through the screen or strainer 11 and into opening 15 for securing screen 11 to center bar 14. The tamper-resistant screw head 13 would make it at least extremely difficult for someone to purposely remove the screen from the center bar and, therefore, defeat its purpose.

Figure 3A:
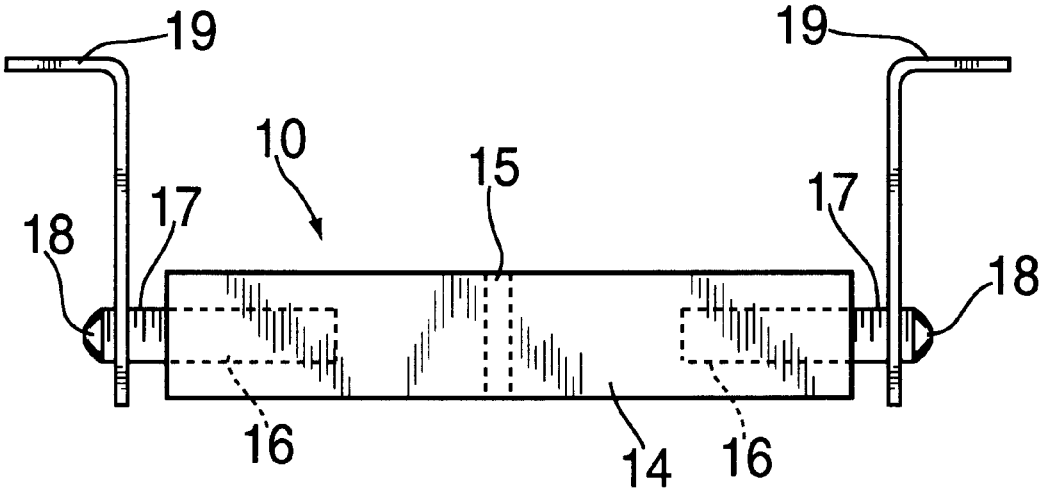
FIGS. 3*a* and 3*b* are respectively a side elevational view and a bottom plan view of the invention shown in FIGS. 1 and 2 but not showing its environment.
Figure 3B:
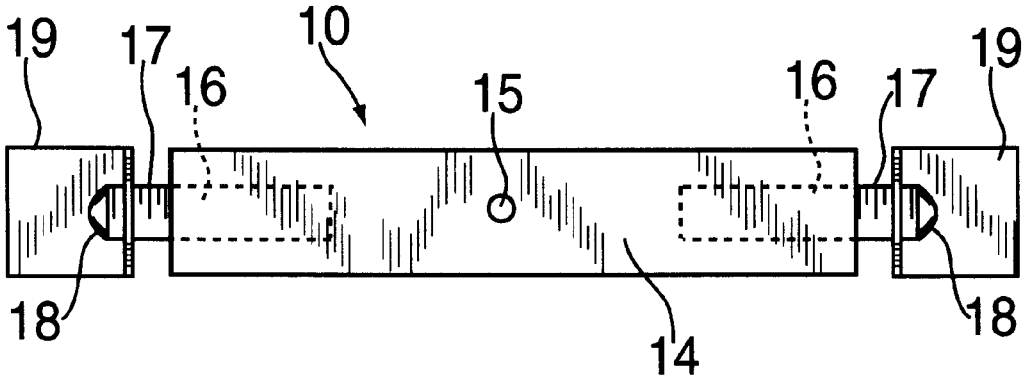

Rod receiving openings such as shown in FIGS. 2, 3*a*, and 3*b*, extend horizontally through each end of center bar 14 with each having internal threads; one such opening 16 having left-hand internal threads and the other having right-hand internal threads.

Threaded rods 17; one have left-hand threads and the other having right-hand threads, threadably engage the rod receiving openings 16. The end 18 which projects outwardly of center bar 14 has a machined point which causes the threaded rod 17 to bite into the wall of the drain pipe thereby causing the drain cover locking device 10 to have more stability when it is tightened into place as will be more fully described below.

"L" shaped hangers 19 are attached to an end of each threaded rod 17 with the ends 18 of threaded rods 17 extending through openings in the long leg of the "L" shaped hangers. These "L" shaped hangers may be attached to threaded rods 17 in any convenient fashion such as by welding.

The other or short leg of the "L" shaped hangers cooperate with the outer diameter of the drain or discharge pipe to hold the drain cover locking device 10 in place to prevent it from falling into the drain pipe.

In operation, each of the two "L" shaped hangers 19 are used to rotate the threaded rods 17 into or out of the center bar until roughly the inside diameter of the drain or discharge pipe is attained and the drain cover locking device is then put into place inside the drain pipe with the ears or short leg of the "L" shaped hangers 19 loosely resting on the outer diameter of the drain. The center bar 14 is then further rotated by means of a wrench such as shown on 20 in FIG. 2 or by any other well known device until the center bar is firmly held in place over the pipe with opening 15 aligned in a vertical position all as best seen in FIGS. 1 and 4.

A drain screen or strainer such as shown at 11 is then placed over the pipe with its center hole aligned with the center hole of the center bar 14. The fastening device shown at 12 is then threaded through the screen or strainer and into the center bar for holding the screen in place.

Though the invention has been described and illustrated with reference to a preferred embodiment thereof, those skilled in the art will appreciate that various changes and modification in shape, size, composition, and arrangement of parts may be resorted to without departing from the spirit of the invention or scope of the subjoined claims.

What is claimed:

1. A drain cover locking device in combination with a screen or strainer comprising:

(a) a center bar;

(b) an opening extending vertically through said center bar;

(c) means for holding said center bar inside a drain or discharge pipe;

(d) means for attaching said screen or strainer to said center bar at said opening extending vertically through said center bars wherein said attaching means is a fastening device having a tamper-resistant screw head wherein said fastening device extends through said screen or strainer and into said opening extending vertically through said center bar and wherein said means for holding said center bar inside a drain or discharge pipe is a pair of "L" shaped hangers wherein a long leg of each "L" is attached to one end each of said center bar.

2. The drain cover locking device in combination with a screen or strainer of claim 1 wherein said center bar has a rod receiving opening extending horizontally through each end for threadably receiving, at each end, a threaded rod to which is attached said long leg of said "L" shaped hanger for attaching said hanger to said end of said center bar.

3. The drain cover locking device in combination with a screen or strainer of claim 2 wherein said threaded rods each have a machined point end for engaging the inside wall of said drain or discharge pipe.

4. The drain cover locking device in combination with a screen or strainer of claim 3 wherein said long leg of said "L" shaped hanger is attached to said threaded rod by means of welding.

5. The drain cover locking device in combination with a screen or strainer of claim 4 wherein a short leg of each "L" shaped hanger slidably engages the outer diameter of said drain or discharge pipe when said center bar is disposed inside said drain or discharge pipe.

6. The drain cover locking device in combination with a screen or strainer of claim 5 wherein one of said rod receiving openings and one of said threaded rods have left-hand screw threads and the other of said rod receiving openings and said threaded rod have right-hand screw threads whereby upon turning each of said "L" shaped hangers said threaded rods will be caused to rotate out of said center bar and thereby causing said machined point ends to engage the inside wall of said drain or discharge pipe.

* * * * *